US011573499B2

(12) United States Patent
Murakami et al.

(10) Patent No.: US 11,573,499 B2
(45) Date of Patent: Feb. 7, 2023

(54) PROCESS CARTRIDGE AND ELECTROPHOTOGRAPHIC APPARATUS

(71) Applicant: CANON KABUSHIKI KAISHA, Tokyo (JP)

(72) Inventors: Takeshi Murakami, Yokohama (JP); Kazunori Noguchi, Suntou-gun (JP); Harunobu Ogaki, Oyama (JP); Kenta Kamikura, Yokohama (JP); Yuzo Seino, Gotemba (JP); Takashi Kenmoku, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 289 days.

(21) Appl. No.: 16/934,164

(22) Filed: Jul. 21, 2020

(65) Prior Publication Data

US 2021/0026268 A1 Jan. 28, 2021

(30) Foreign Application Priority Data

Jul. 25, 2019 (JP) ..... JP2019-137132
Jun. 30, 2020 (JP) ..... JP2020-113398

(51) Int. Cl.
*G03G 9/09* (2006.01)
*G03G 9/093* (2006.01)
(Continued)

(52) U.S. Cl.
CPC ..... *G03G 9/09342* (2013.01); *G03G 5/14704* (2013.01); *G03G 9/0825* (2013.01);
(Continued)

(58) Field of Classification Search
CPC ..... G03G 5/14734; G03G 5/072; G03G 9/09328; G03G 9/09783; G03G 15/087; G03G 21/1814; G03G 9/097
See application file for complete search history.

(56) References Cited

U.S. PATENT DOCUMENTS 4,908,329 A 3/1990 Kanai et al.
4,908,330 A 3/1990 Arai et al.
(Continued)

FOREIGN PATENT DOCUMENTS

JP 2001-209207 8/2001
JP 2003-084490 3/2003
(Continued)

OTHER PUBLICATIONS

U.S. Appl. No. 16/934,172, Kazunori Noguchi, filed Jul. 21, 2020.

*Primary Examiner* — Francis C Gray
(74) *Attorney, Agent, or Firm* — Venable LLP

(57) ABSTRACT

Provided is a process cartridge detachably attachable to a main body of an electrophotographic apparatus, the process cartridge including: a developing unit including a toner; and an electrophotographic photosensitive member, wherein the toner includes a toner particle, the toner particle has a surface containing a polyvalent acid metal salt particle, and a surface layer of the electrophotographic photosensitive member contains at least one metal oxide particle among an aluminum oxide particle, a silicon dioxide particle, and a tin oxide particle.

7 Claims, 1 Drawing Sheet

(51) Int. Cl.

| | |
|---|---|
| ***G03G 5/147*** | (2006.01) |
| ***G03G 9/097*** | (2006.01) |
| ***G03G 9/087*** | (2006.01) |
| ***G03G 21/18*** | (2006.01) |
| ***G03G 9/08*** | (2006.01) |

(52) U.S. Cl.
CPC ..... *G03G 9/08711* (2013.01); *G03G 9/08755* (2013.01); *G03G 9/09708* (2013.01); *G03G 9/09725* (2013.01); *G03G 9/09775* (2013.01); *G03G 21/1803* (2013.01)

(56) References Cited

U.S. PATENT DOCUMENTS

| | | | |
|---|---|---|---|
| 5,759,291 | A | 6/1998 | Ichinose et al. |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |
| 7,413,840 | B1 | 8/2008 | Ogaki et al. |
| 7,551,878 | B2 | 6/2009 | Ogaki et al. |
| 7,553,594 | B2 | 6/2009 | Ogaki et al. |
| 7,585,604 | B2 | 9/2009 | Ogaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,799,496 | B2 | 9/2010 | Uesugi et al. |
| 7,838,190 | B2 | 11/2010 | Ogaki et al. |
| 7,875,410 | B2 | 1/2011 | Ogaki et al. |
| 7,927,774 | B2 | 4/2011 | Ogaki et al. |
| 7,931,848 | B2 | 4/2011 | Ochi et al. |
| 8,457,528 | B2 | 6/2013 | Ochi et al. |
| 8,669,027 | B2 | 3/2014 | Anezaki et al. |
| 8,753,789 | B2 | 6/2014 | Ogaki et al. |
| 8,815,479 | B2 | 8/2014 | Shida et al. |
| 8,841,052 | B2 | 9/2014 | Watariguchi et al. |
| 8,846,281 | B2 | 9/2014 | Okuda et al. |
| 8,865,380 | B2 | 10/2014 | Noguchi et al. |
| 8,921,020 | B2 | 12/2014 | Murai et al. |
| 8,974,991 | B2 | 3/2015 | Kawahara et al. |
| 8,980,508 | B2 | 3/2015 | Okuda et al. |
| 8,980,509 | B2 | 3/2015 | Noguchi et al. |
| 9,034,545 | B2 | 5/2015 | Maruyama et al. |
| 9,068,083 | B2 | 6/2015 | Tanaka et al. |
| 9,114,565 | B2 | 8/2015 | Kawai et al. |
| 9,188,888 | B2 | 11/2015 | Okuda et al. |
| 9,207,550 | B2 | 12/2015 | Okuda et al. |
| 9,235,144 | B2 | 1/2016 | Yamamoto et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,416 | B2 | 4/2016 | Noguchi et al. |
| 9,341,964 | B2 | 5/2016 | Ogaki et al. |
| 9,405,206 | B2 | 8/2016 | Kawaguchi et al. |
| 9,436,107 | B2 | 9/2016 | Murakami et al. |
| 9,459,542 | B2 | 10/2016 | Tanaka et al. |
| 9,507,283 | B2 | 11/2016 | Maruyama et al. |
| 9,535,347 | B2 | 1/2017 | Watariguchi et al. |
| 9,575,422 | B2 | 2/2017 | Okuda et al. |
| 9,599,917 | B2 | 3/2017 | Okuda et al. |
| 9,651,879 | B2 | 5/2017 | Maruyama et al. |
| 9,658,543 | B2 | 5/2017 | Murakami et al. |
| 9,726,992 | B2 | 8/2017 | Sakuma et al. |
| 9,772,569 | B2 | 9/2017 | Tanaka et al. |
| 9,791,792 | B2 | 10/2017 | Miyauchi et al. |
| 9,851,646 | B2 | 12/2017 | Tomono et al. |
| 10,018,928 | B2 | 7/2018 | Murakami et al. |
| 10,095,137 | B2 | 10/2018 | Murakami et al. |
| 10,452,021 | B2 | 10/2019 | Miura et al. |
| 10,545,453 | B2 | 1/2020 | Iwasaki et al. |
| 10,663,913 | B2 | 5/2020 | Yamaai et al. |
| 2004/0126687 | A1* | 7/2004 | Ikegami ..... G03G 5/0612 430/58.75 |
| 2005/0208402 | A1 | 9/2005 | Tanaka et al. |
| 2014/0154618 | A1 | 6/2014 | Maruyama et al. |
| 2015/0185630 | A1 | 7/2015 | Ito et al. |
| 2016/0139556 | A1* | 5/2016 | Yamamoto ..... G03G 5/0564 430/105 |
| 2017/0060008 | A1 | 3/2017 | Okuda et al. |
| 2019/0369512 | A1* | 12/2019 | Okuda ..... G03G 5/1473 |
| 2019/0369529 | A1* | 12/2019 | Yagi ..... G03G 9/08797 |
| 2020/0124998 | A1* | 4/2020 | Kototani ..... G03G 9/0821 |

FOREIGN PATENT DOCUMENTS

| | | |
|---|---|---|
| JP | 2006-178412 | 7/2006 |
| JP | 2010-078931 | 4/2010 |
| JP | 2014-109582 | 6/2014 |

* cited by examiner

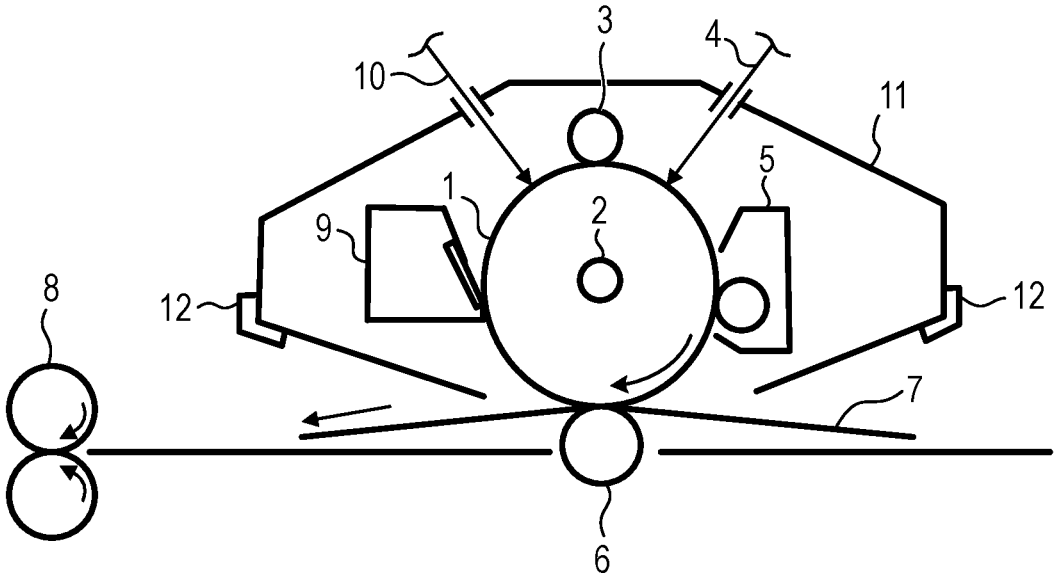
3
4
10
11
5
1
2
9
8
12
12
7
6

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus.

Description of the Related Art

Recently, in an electrophotographic process, it has been desired to decrease a size of an electrophotographic apparatus and to increase the number of printable sheets. Accordingly, it is required to further reduce toner consumption. It is required to reduce fogging caused by development of a toner in a non-image area to reduce the toner consumption.

Japanese Patent Application Laid-Open No. 2001-209207 discloses a toner having improved developability and durability by attaching an inorganic fine particle composed of a phosphate anion and a zirconium ion to a surface of a toner.

Japanese Patent Application Laid-Open No. 2006-178412 discloses a technology for suppressing fogging by allowing a surface layer of an electrophotographic photosensitive member to contain a metal oxide particle.

SUMMARY OF THE INVENTION

According to findings by the inventors of the present invention, in process cartridges disclosed in Japanese Patent Application Laid-Open Nos. 2001-209207 and 2006-178412, fogging that is visually observed on an image is suppressed, but it is required to further reduce the fogging in terms of reducing toner consumption.

An object of the present invention is to provide a process cartridge and an electrophotographic apparatus capable of significantly reducing fogging to reduce toner consumption.

The above object is achieved by the following present invention. A process cartridge according to an aspect of the present invention includes: a developing unit including a toner; and an electrophotographic photosensitive member, wherein the toner includes a toner particle, the toner particle has a surface containing a polyvalent acid metal salt particle, and a surface layer of the electrophotographic photosensitive member contains at least one metal oxide particle among an aluminum oxide particle, a silicon dioxide particle, and a tin oxide particle.

An electrophotographic apparatus according to another aspect of the present invention includes the process cartridge.

According to the present invention, it is possible to provide a process cartridge and an electrophotographic apparatus capable of significantly reducing fogging to reduce toner consumption.

Further features of the present invention will become apparent from the following description of exemplary embodiments with reference to the attached drawing.

BRIEF DESCRIPTION OF THE DRAWINGS

FIGURE is a view illustrating an example of a schematic configuration of an electrophotographic apparatus provided with a process cartridge according to the present invention.

DESCRIPTION OF THE EMBODIMENTS

Hereinafter, the present invention will be described in detail with reference to preferred embodiments.

In order to solve the above problem, a feature of the present invention is that a toner and an electrophotographic photosensitive member are used together, the toner including a toner particle having a surface containing a polyvalent acid metal salt particle, and the electrophotographic photosensitive member having a surface layer containing a metal oxide particle.

Regarding a mechanism for reducing fogging by using the toner and the electrophotographic photosensitive member that satisfy the above feature together, a presumption of the inventors of the present invention is as follows.

In an electrophotographic process, as an image forming method, a method of forming a toner image on an electrophotographic photosensitive member and then transferring and forming the formed toner image onto an intermediate transfer body or a sheet is generally used.

A toner having a surface containing a polyvalent acid metal salt particle is likely to be negatively charged by polarization of the polyvalent acid metal salt particle and is excellent in chargeability. In addition, charges easily move due to an appropriate resistance value of the polyvalent acid metal salt particle.

On the other hand, an electrophotographic photosensitive member having a surface layer containing a metal oxide particle is likely to be positively charged as compared to the toner having the surface containing the polyvalent acid metal salt particle.

Therefore, it is presumed that when the toner image is formed on the electrophotographic photosensitive member, a negative charge is supplied from the electrophotographic photosensitive member to the toner to improve charge uniformity of the toner and to reduce fogging.

[Toner]

A toner includes a toner particle. A surface of the toner particle contains a polyvalent acid metal salt particle.

A polyvalent acid contained in the polyvalent acid metal salt particle may be any acid as long as it is a di- or higher-valent acid. Specific examples thereof include the following:

an inorganic acid such as phosphoric acid, carbonic acid, or sulfuric acid; and an organic acid such as dicarboxylic acid or tricarboxylic acid.

Specific examples of the organic acid include the following:

dicarboxylic acid such as oxalic acid, malonic acid, succinic acid, glutaric acid, adipic acid, fumaric acid, maleic acid, pimelic acid, suberic acid, azelaic acid, sebacic acid, phthalic acid, isophthalic acid, or terephthalic acid; and tricarboxylic acid such as citric acid, aconitic acid, or trimellitic anhydride.

Among them, the polyvalent acid preferably contains at least one selected from the group consisting of carbonic acid, sulfuric acid, and phosphoric acid that are inorganic acids in terms of suppression of moisture absorption by a strong reaction with a metal element. More preferably, the polyvalent acid contains phosphoric acid.

The polyvalent acid metal salt particle preferably contains at least one metal element selected from metal elements included in Groups 3 to 13 as a metal element. A salt composed of metal elements included in Groups 3 to 13 and a polyvalent acid has low absorptivity, and thus, fogging can be stably reduced even in a high humidity environment.

Specific examples of the metal element contained in the polyvalent acid metal salt particle can include titanium, zirconium, aluminum, zinc, indium, hafnium, iron, copper and silver. Among them, the metal element contained in the polyvalent acid metal salt particle is preferably a metal that can have a tri- or higher-valence. More preferably, the metal element is titanium, zirconium, or aluminum, and still more preferably the metal element is titanium.

Specific examples of the polyvalent acid metal salt particle obtained by combining the metal and the polyvalent acid can include particles formed of a metal phosphate such as a titanium phosphate compound, a zirconium phosphate compound, an aluminum phosphate compound, or a phosphoric acid copper compound, a metal sulfate such as a titanium sulfate compound, a zirconium sulfate compound, or an aluminum sulfate compound, a metal carbonate such as a titanium carbonate compound, a zirconium carbonate compound, or an aluminum carbonate compound, and a metal oxalate such a titanium oxalate compound. Among them, a metal phosphate particle is preferable, and a titanium phosphate compound particle is more preferable, in terms of a high strength due to crosslinking of metals by phosphate ions and an excellent charge rising property due to an ionic bond formed in a molecule.

A method for obtaining the polyvalent acid metal salt particle is not particularly limited, and methods known in the related art can be used. Among them, a method for obtaining a polyvalent acid metal salt particle by reacting a metal compound which is a metal source with a polyvalent acid ion in an aqueous medium is preferably used.

As the metal source in the case of obtaining the polyvalent acid metal salt particle by the above method, any metal compound known in the related art can be used without a particular limitation as long as it is a metal compound capable of producing a polyvalent acid metal salt particle by a reaction with a polyvalent acid ion.

Specific examples of the metal compound producing the polyvalent acid metal salt particle by the reaction with the polyvalent acid ion can include a metal chelate such as titanium lactate, titanium tetraacetylacetonate, a titanium lactate ammonium salt, titanium triethanolaminate, zirconium lactate, a zirconium lactate ammonium salt, aluminum lactate, aluminum trisacetylacetonate, or copper lactate, and a metal alkoxide such as titanium tetraisopropoxide, titanium ethoxide, zirconium tetraisopropoxide, or aluminum trisisopropoxide. Among them, a metal chelate is preferable in terms of an easy control of a reaction and a quantitative reaction with a polyvalent acid ion. In addition, a lactic acid chelate such as titanium lactate or zirconium lactate is more preferable from the viewpoint of solubility to the aqueous medium.

As the polyvalent acid ion in the case of obtaining the polyvalent acid metal salt particle by the above method, the polyvalent acid ion described above can be used. In a case where the polyvalent acid ion is added to the aqueous medium, a polyvalent acid may be added to the aqueous medium as it is, and a water-soluble polyvalent acid metal salt may be added to and dissociated in the aqueous medium.

A number average particle diameter of the polyvalent acid metal salt particles is preferably 1.0 nm or more and 400 nm or less, more preferably 1.0 nm or more and 200 nm or less, and still more preferably 1.0 nm or more and 60 nm or less.

When the number average particle diameter of the polyvalent acid metal salt particles is in the above range, the polyvalent acid metal salt particles transfer from the toner to a surface of the electrophotographic photosensitive member or other members, such that contamination of members can be suppressed. Thus, negative chargeability of the surface of the toner and positive chargeability of the surface of the electrophotographic photosensitive member are easily maintained. Therefore, the fogging can be more easily reduced.

As a method of adjusting the number average particle diameter of the polyvalent acid metal salt particles to be in the above range, it is possible to use a method of controlling addition amounts of the polyvalent acid and the compound containing the metal element that are raw materials of the polyvalent acid metal salt particle, or a pH and a temperature when the polyvalent acid is reacted with the compound containing the metal element.

As a method of producing a reaction product of the polyvalent acid and the compound containing the metal element on the surface of the toner particle, for example, it is possible to use a method of attaching a reaction product of a polyvalent acid and a compound containing a metal element to a surface of a toner base particle in a toner base particle dispersion. In this case, when the toner base particles are produced in an aqueous medium, the aqueous medium containing the produced toner base particles may be used as a toner base particle dispersion as it is. In addition, after the toner base particles are produced in the aqueous medium, washing, filtering, and drying may be performed, and then a solution obtained by re-dispersing the toner base particles in the aqueous medium may also be used as the toner base particle dispersion. On the other hand, when the toner base particles are produced in a dry manner, the toner base particles may be dispersed in an aqueous medium by a known method, and the aqueous medium may also be used as the toner base particle dispersion. In this case, in order to disperse the toner base particles in the aqueous medium, the aqueous medium preferably contains a dispersion stabilizer.

<Method of Detecting Polyvalent Acid Metal Salt Particle>

The polyvalent acid metal salt particle contained in the surface of the toner particle can be detected by the following methods by using time-of-flight secondary ion mass spectrometry (TOF-SIMS).

A toner sample is analyzed under the following conditions by using TOF-SIMS (TRIFTIV, manufactured by ULVAC-PHI, Incorporated).

Primary ion species: gold ion ($Au^+$)
Primary ion current value: 2 pA
Analysis area: 300×300 $\mu m^2$
Number of pixels: 256×256 pixel
Analysis time: 3 min
Repetition frequency: 8.2 kHz
Charge neutralization: ON
Secondary ion polarity: Positive
Secondary ion mass range: m/z 0.5 to 1,850
Sample substrate: indium When the analysis is performed under the above conditions to detect a peak derived from a secondary ion including a metal ion and a polyvalent acid ion (for example, in a case of titanium phosphate, $TiPO_3$ (m/z 127), $TiP_2O_5$ (m/z 207), and the like), the presence of the polyvalent acid metal salt particle contained in the surface of the toner can be confirmed.

The toner particle preferably includes: a toner base particle containing a binder resin; and an organosilicon polymer contained in a surface of the toner base particle.

The organosilicon polymer is preferably present on the surface of the toner base particle as described below. That is, in a case where a polyvalent acid is reacted with a compound containing a metal element in a toner base particle dispersion, and the obtained reaction product is attached to the surface of the toner base particle to obtain a toner particle, an organosilicon compound represented by the following Formula (T-1) is used in the production of the toner particle.

$$R_{a(n)}—Si—R_{b(4-n)} \quad (T-1)$$

In Formula (T-1), $R_a$ represents a halogen atom, a hydroxy group, or an alkoxy group, and $R_b$ represents an alkyl group, an alkenyl group, an aryl group, an acyl group, or a methacryloxyalkyl group. n represents an integer of 2 or more and 4 or less. In a case where $R_a$ and $R_b$ are present in plural, a plurality of $R_a$'s and a plurality of $R_b$'s may be the same as each other or different from each other.

Hereinafter, $R_a$ in Formula (T-1) is referred to as a functional group, and $R_b$ in Formula (T-1) is referred to as a substituent.

By using the organosilicon compound represented by Formula (T-1), the reaction product obtained by the reaction of the polyvalent acid with the compound containing the metal element is further firmly fixed to the toner particle and the surface is hydrophobized. Thus, stability of triboelectrification is further improved in a high humidity environment.

Specifically, first, the organosilicon compound represented by Formula (T-1) is hydrolyzed in advance or is hydrolyzed in the toner base particle dispersion.

Thereafter, the obtained hydrolysate of the organosilicon compound is condensed in the toner base particle dispersion to obtain a condensate.

The condensate transfers to the surface of the toner base particle. Since the condensate is viscous, the reaction product of the polyvalent acid and the compound containing the metal element can be further firmly fixed to the toner particle by bringing the reaction product in close contact with the surface of the toner particle.

In addition, the condensate also transfers to a surface of the reaction product and the reaction product is hydrophobized, such that the stability of triboelectrification can be further improved in a high humidity environment.

The organosilicon compound represented by Formula (T-1) is not particularly limited, and a known organosilicon compound can be used. Specifically, examples of the organosilicon compound can include a difunctional silane compound having two functional groups, a trifunctional silane compound having three functional groups, and a tetrafunctional silane compound having four functional groups.

Examples of the difunctional silane compound can include dimethyldimethoxysilane and dimethyldiethoxysilane.

Examples of the trifunctional silane compound can include the following:

a trifunctional silane compound having an alkyl group as a substituent, such as methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, or decyltriethoxysilane; a trifunctional silane compound having an alkenyl group as a substituent, such as vinyltrimethoxysilane, vinyltriethoxysilane, allyltrimethoxysilane, or allyltriethoxysilane; a trifunctional silane compound having an aryl group as a substituent, such as phenyltrimethoxysilane or phenyltriethoxysilane; and a trifunctional silane compound having a methacryloxyalkyl group as a substituent, such as γ-methacryloxypropyltrimethoxysilane, γ-methacryloxypropyltriethoxysilane, γ-methacryloxypropyldiethoxymethoxysilane, or γ-methacryloxypropylethoxydimethoxysilane.

Examples of the tetrafunctional silane compound can include tetramethoxysilane, tetraethoxysilane, tetrapropoxysilane, and tetrabutoxysilane.

A content of a condensate of at least one organosilicon compound selected from the group consisting of the organosilicon compound represented by Formula (T-1) in the toner particle is preferably 0.1% by mass or more and 20.0% by mass or less, and more preferably 0.5% by mass or more and 15.0% by mass or less.

A method of producing the toner base particle is not particularly limited, and a known suspension polymerization method, dissolution suspension method, emulsion aggregation method, or grinding method can be used.

Hereinafter, an example of producing a toner base particle using a suspension polymerization method will be specifically described.

First, a polymerizable monomer capable of producing a binder resin and, if necessary, various additives are mixed with each other, and the materials are dissolved or dispersed using a disperser to prepare a polymerizable monomer composition.

Examples of the additives can include a coloring agent, wax, a charge control agent, a polymerization initiator, and a chain transfer agent.

Examples of the disperser can include a homogenizer, a ball mill, a colloid mill, and an ultrasonic disperser.

Next, the polymerizable monomer composition is injected to an aqueous medium containing a slightly water-soluble inorganic fine particle, and droplets of the polymerizable monomer composition are prepared using a high-speed disperser such as a high-speed stirrer or an ultrasonic disperser (granulation step).

Thereafter, polymerizable monomers in the droplets are polymerized to obtain a toner base particle (polymerization step).

The polymerization initiator may be mixed at the time of preparing the polymerizable monomer composition or may be mixed in the polymerizable monomer composition immediately before the droplets are formed in the aqueous medium. In addition, the polymerization initiator can also be added in a state of being dissolved in the polymerizable monomer or another solvent, if necessary, during granulation of the droplets or after completion of granulation, that is, immediately before start of a polymerization reaction.

After resin particles are obtained by polymerizing the polymerizable monomers, a solvent removal treatment may be performed, if necessary, to obtain a toner base particle dispersion.

Examples of the binder resin can include the following resins or polymers.

Examples of the resin can include a vinyl resin, a polyester resin, a polyamide resin, a furan resin, an epoxy resin, a xylene resin, and a silicone resin.

Among them, a vinyl resin is preferable. Examples of the vinyl resin can include polymers of the following monomers or copolymers thereof. Among them, a copolymer of a styrene-based monomer and an unsaturated carboxylic acid ester is preferable.

Examples of the monomer can include a styrene-based monomer such as styrene or α-methylstyrene; an unsaturated carboxylic acid ester such as methyl acrylate, butyl acrylate, methyl methacrylate, 2-hydroxyethyl methacrylate, t-butyl methacrylate, or 2-ethylhexyl methacrylate; an unsaturated carboxylic acid such as acrylic acid or methacrylic acid; an unsaturated dicarboxylic acid such as maleic acid; an unsaturated dicarboxylic acid anhydride such as maleic anhydride; a nitrile-based vinyl monomer such as acrylonitrile; a halogen-containing vinyl monomer such as vinyl chloride; and a nitro-based vinyl monomer such as nitrostyrene.

The following black pigment, yellow pigment, magenta pigment, cyan pigment, and the like can be used as the coloring agent.

Example of the black pigment can include carbon black.

Examples of the yellow pigment can include a monoazo compound, a disazo compound, a condensed azo compound, an isoindolinone compound, an isoindoline compound, a benzimidazolone compound, an anthraquinone compound, an azo metal complex, a methine compound, and an allylamide compound.

Specific examples of the yellow pigment can include C.I. Pigment Yellow 74, 93, 95, 109, 111, 128, 155, 174, 180, and 185.

Examples of the magenta pigment can include a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Specific examples of the magenta pigment can include C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269, and C.I. Pigment Violet 19.

Examples of the cyan pigment can include a copper phthalocyanine compound and a derivative thereof, an anthraquinone compound, a basic dye lake compound.

Specific examples of the cyan pigment can include C.I. Pigment Blue 1, 7, 15, 15:1, 15:2, 15:3, 15:4, 60, 62, and 66.

In addition, various dyes known in the related art as the coloring agent may be used together with the pigment.

A content of the coloring agent is preferably 1.0 part by mass or more and 20.0 parts by mass or less with respect to 100 parts by mass of the binder resin.

It is also possible to obtain a magnetic toner by allowing the toner to contain a magnetic body. In this case, the magnetic body can also serve as a coloring agent.

Examples of the magnetic body can include iron oxides represented by magnetite, hematite, and ferrite, metals represented by iron, cobalt, and nickel, and alloys of these metals with a metal such as aluminum, cobalt, copper, lead, magnesium, tin, zinc, antimony, beryllium, bismuth, cadmium, calcium, manganese, selenium, titanium, tungsten, or vanadium, and mixtures thereof.

Examples of the wax can include the following:

esters of a monohydric alcohol and an aliphatic monocarboxylic acid, or esters of a monovalent carboxylic acid and an aliphatic monoalcohol, such as behenyl behenate, stearyl stearate, and palmityl palmitate; esters of a dihydric alcohol and an aliphatic monocarboxylic acid, or esters of a divalent carboxylic acid and an aliphatic monoalcohol, such as dibehenyl sebacate and hexanediol dibehenate; esters of a trihydric alcohol and an aliphatic monocarboxylic acid, or esters of a trivalent carboxylic acid and an aliphatic monoalcohol, such as glycerin tribehenate; esters of a tetrahydric alcohol and an aliphatic monocarboxylic acid, or esters of a tetravalent carboxylic acid and an aliphatic monoalcohol, such as pentaerythritol tetrastearate and pentaerythritol tetrapalmitate; esters of a hexahydric alcohol and an aliphatic monocarboxylic acid, or esters of a hexavalent carboxylic acid and an aliphatic monoalcohol, such as dipentaerythritol hexastearate and dipentaerythritol hexapalmitate; esters of a polyhydric alcohol and an aliphatic monocarboxylic acid, or esters of a polyvalent carboxylic acid and an aliphatic monoalcohol, such as polyglycerin behenate; natural ester wax such as carnauba wax and rice wax; petroleum wax such as paraffin wax, microcrystalline wax, and petrolatum, and derivatives thereof; hydrocarbon wax obtained by the Fischer-Tropsch method and derivatives thereof; polyolefin wax such as polyethylene wax and polypropylene wax and derivatives thereof; higher aliphatic alcohols; fatty acids such as stearic acid and palmitic acid; and acid amide wax.

A content of the wax is preferably 0.5 parts by mass or more and 20.0 parts by mass or less with respect to 100 parts by mass of the binder resin.

Various organic fine particles or inorganic fine particles may be externally added to the toner particle to an extent that characteristics of the toner are not impaired. Examples of the organic fine particles or inorganic fine particles include the following materials.

Fluidity imparting agent: silica, alumina, titanium oxide, carbon black, and carbon fluoride Abrasive: metal oxide (for example, strontium titanate, cerium oxide, alumina, magnesium oxide, and chromium oxide), nitride (for example, silicon nitride), carbide (for example, silicon carbide), and metal salt (for example, calcium sulfate, barium sulfate, and calcium carbonate)

Lubricant: fluorine-based resin fine particle (for example, vinylidene fluoride and polytetrafluoroethylene) and fatty acid metal salt (for example, zinc stearate and calcium stearate)

Charge control particle: metal oxide (for example, tin oxide, titanium oxide, zinc oxide, silica, and alumina) and carbon black The organic fine particles or inorganic fine particles can be subjected to a hydrophobic treatment. Examples of a treatment agent for the hydrophobic treatment of the organic fine particles or inorganic fine particles can include an unmodified silicone varnish, various modified silicone varnishes, unmodified silicone oil, various modified silicone oils, a silane compound, a silane coupling agent, other organosilicon compounds, and an organotitanium compound. These treatment agents may be used alone or in combination.

<Structure of Cross Section of Toner Particle>

It is preferable that the toner particle includes: a toner base particle containing a binder resin; and a projection formed on a surface of the toner base particle, and the projection contains an organosilicon polymer.

Hereinafter, a method of confirming a structure of the toner particle by observing a cross section of the toner particle with a transmission electron microscope (TEM) will be described.

First, the cross section of the toner particle observed with the transmission electron microscope (TEM) is analyzed by energy dispersive X-ray (EDX) spectrometry. On an EDX mapping image of constituent elements in the cross section of the toner particle thus obtained, an image of the toner base particle and an image of the organosilicon polymer can be observed. Furthermore, a projection is confirmed on the image of the organosilicon polymer, the projection being formed at a position corresponding to the surface of the toner base particle of the image of the toner base particle, such that it can be confirmed that the toner particle has the projection formed on the surface of the toner base particle and containing the organosilicon polymer. A height H of the projection is preferably 30 nm or more and 300 nm or less, the projection being formed on the surface of the toner base particle of the toner particle and containing the organosilicon polymer.

<Method of Calculating Height H of Projection>

The cross section of the toner particle is observed by the following method with a transmission electron microscope (TEM).

First, the toner particles are sufficiently dispersed in a normal temperature curable epoxy resin, and then the dispersed toner particles are cured under an atmosphere of 40° C. for 2 days.

A flaky sample having a thickness of 50 nm is cut out from the obtained cured product using a microtome equipped with a diamond blade (EM UC7, manufactured by Leica Microsystems).

The sample is magnified at a magnification of 500,000 under conditions of an acceleration voltage of 200 V and an electron beam probe size of 1 mm with a TEM (JEM 2800, manufactured by JEOL Ltd.) to observe the cross section of the toner particle. In this case, the cross section of the toner particle having a maximum diameter of 0.9 times to 1.1 times the number average particle diameter (D1) when the toner is measured is selected according to a method of measuring the number average particle diameter (D1) of the toner particles to be described below. Subsequently, the constituent elements in the obtained cross section of the toner particle are analyzed by energy dispersive X-ray (EDX) spectrometry to create an EDX mapping image (256×256 pixel (2.2 nm/pixel), number of integrations: 200 times).

When a signal from a silicon element contained in the surface of the toner base particle is observed in the created EDX mapping image, the signal is defined as an image of the organosilicon polymer. In addition, when the images of the organosilicon polymer are continuously observed in the surface of the toner base particle, a line segment obtained by connecting endpoints of the images of the organosilicon polymer is used as a base line. A portion where an intensity of the signal from silicon is equal to a background silicon intensity is defined as an endpoint of the image of the organosilicon polymer.

For each base line, a perpendicular line having a maximum length among perpendicular lines from the base line to an image surface of the organosilicon polymer is found, and the maximum length is defined as a height of the projection. The cross sections of 20 toner particles are analyzed by the above method, and an average value of the obtained heights of the projections is defined as the height H (nm) of the projection.

In the toner, the metal element contained in the polyvalent acid metal salt particle is defined as a metal element M. In a ratio of the constituent elements contained in the surface of the toner particle calculated from a spectrum obtained by an X-ray photoelectron spectroscopic analysis of the toner particle, a ratio of the metal element M is defined as M1 (atomic %). In this case, M1 is preferably 1.0 (atomic %) or more and 10.0 (atomic %) or less.

In addition, 1.0 g of a toner is dispersed in a mixed aqueous solution formed of 31 g of a 61.5% aqueous solution of sucrose and 6 g of a 10% aqueous solution of a neutral detergent for washing a precision measuring apparatus composed of a nonionic surfactant and an anionic surfactant. Subsequently, the toner obtained by a treatment (a) of performing shaking 300 times per minute using a shaker is used as a toner (a). In a ratio of constituent elements contained in the surface of the toner particle calculated from a spectrum obtained by an X-ray photoelectron spectroscopic analysis of the toner (a), a ratio of the metal element M is defined as M2 (atomic %). In this case, it is preferable that both M1 and M2 are 1.0 or more and 10.0 or less and M2/M1 is 0.90 or more.

In the treatment (a), the polyvalent acid metal salt particles that are weakly attached to the surface of the toner can be removed. Specifically, the polyvalent acid metal salt particles that are attached to the toner base particle in a dry manner are easily removed by the treatment (a). As such, a fixed state of the polyvalent acid metal salt particles or the organosilicon polymers that are present on the surface of the toner can be evaluated by the treatment (a). It is indicated that the polyvalent acid metal salt particles are firmly fixed to the toner base particle as a ratio of M2 to M1 obtained after the treatment (a) is large.

Each of M1 and M2 represents a state where the surface of the toner is coated with the polyvalent acid metal salt particle before and after each treatment. In addition, the state where the surface of the toner is coated with the polyvalent acid metal salt particle may contribute to chargeability and charge mobility.

Each of M1 and M2 is preferably 1.0 (atomic %) or more and 10.0 (atomic %) or less. When each of M1 and M2 is in the above range, the negative chargeability and the charge mobility of the toner are excellent. Therefore, the charges smoothly move from the electrophotographic photosensitive member to the toner to easily reduce fogging.

Each of M1 and M2 is more preferably 1.0 (atomic %) or more and 7.0 (atomic %) or less and still more preferably 1.5 (atomic %) or more and 5.0 (atomic %) or less.

M2/M1 refers to a ratio of the polyvalent acid metal salt particle that remains on the surface of the toner without being separated from the surface of the toner in the treatment (a). When M2/M1 is 0.90 or more, the polyvalent acid metal salt particles are firmly fixed to the surface of the toner. Therefore, it is possible to suppress transfer of the polyvalent acid metal salt particle from the toner to the surface of the electrophotographic photosensitive member. As a result, it is possible to obtain a toner having excellent durability and capable of easily maintaining negative chargeability of the surface of the toner and positive chargeability of the surface of the electrophotographic photosensitive member and stably reducing fogging even during long-term use.

In addition, M2/M1 is more preferably 0.95 or more.

<Method of Forming Projection Containing Organosilicon Polymer>

A method of forming a projection containing an organosilicon polymer according to the present invention is not particularly limited, and a method known in the related art can be used. An example thereof can include a method of condensing a hydrolysate of an organosilicon compound represented by Formula (T-1) (hereinafter, simply referred to as an organosilicon compound) in a toner base particle dispersion in an aqueous medium in which the toner base particles are dispersed to form a projection on a toner base particle. In addition, an example thereof can include a method of attaching a projection containing an organosilicon polymer to a toner base particle produced in a dry manner or in a wet manner by a mechanical external force.

Among them, a method of condensing a hydrolysate of an organosilicon compound in a toner base particle dispersion in an aqueous medium in which the toner base particles are dispersed is preferable in terms of being capable of firmly fixing the projection to the toner base particle.

Hereinafter, the above method will be described.

In a case where a projection is formed on a toner base particle by the above method, it is preferable to include the following steps 1 and 2: a step of dispersing toner base particles in an aqueous medium to obtain a toner base particle dispersion (step 1); and a step of mixing an organosilicon compound (or a hydrolysate thereof) with the toner base particle dispersion and performing a condensation reaction of the organosilicon compound in the toner base particle dispersion to form a projection containing an organosilicon polymer on the toner base particle (step 2).

Examples of a method of obtaining the toner base particle dispersion in the step 1 can include a method of using a toner base particle dispersion produced in an aqueous medium as it is and a method of injecting and mechanically dispersing dried toner base particles into an aqueous medium. In a case where the dried toner base particles are dispersed in the aqueous medium, a dispersion aid may be used.

As the dispersion aid, a known dispersion stabilizer or surfactant can be used. Specific examples of the dispersion stabilizer can include an inorganic dispersion stabilizer such as tricalcium phosphate, hydroxyapatite, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, or alumina, and an organic dispersion stabilizer such as polyvinyl alcohol, gelatin, methyl cellulose, methyl hydroxypropyl cellulose, ethyl cellulose, a carboxymethyl cellulose sodium salt, or starch. In addition, examples of the surfactant can include an anionic surfactant such as an alkyl sulfate ester salt, alkylbenzene sulfonate, or a fatty acid salt, a nonionic surfactant such as polyoxyethylene alkyl ether or polyoxypropylene alkyl ether, and a cationic surfactant such as an alkyl amine salt or a quaternary ammonium salt. Among them, an inorganic dispersion stabilizer is preferable, and a dispersion stabilizer containing a phosphoric acid salt such as tricalcium phosphate, hydroxyapatite, magnesium phosphate, zinc phosphate, or aluminum phosphate is more preferable.

In the step 2, the organosilicon compound may be added to the toner base particle dispersion as it is or may be added to the toner base particle dispersion after hydrolysis. Among them, the organosilicon compound is preferably added after hydrolysis in terms of easily controlling the condensation reaction and reducing the amount of the organosilicon compound remaining in the toner base particle dispersion. The hydrolysis is preferably performed in an aqueous medium of which a pH is adjusted with a known acid and base. It is known that the hydrolysis of the organosilicon compound depends on a pH. It is preferable that the pH when the hydrolysis is performed is appropriately changed depending on the type of organosilicon compound. For example, when methyltriethoxysilane is used as the organosilicon compound, the pH of the aqueous medium is preferably 2.0 or more and 6.0 or less.

Specific examples of the acid for adjusting the pH can include an inorganic acid such as hydrochloric acid, hydrobromic acid, hydroiodic acid, hypochlorous acid, chlorous acid, chloric acid, perchloric acid, hypobromous acid, bromous acid, bromic acid, perbromic acid, hypoiodous acid, iodous acid, iodic acid, periodic acid, sulfuric acid, nitric acid, phosphoric acid, or boric acid, and an organic acid such as acetic acid, citric acid, formic acid, gluconic acid, lactic acid, oxalic acid, or tartaric acid.

Specific examples of the base for adjusting the pH can include alkali metal hydroxides such as potassium hydroxide, sodium hydroxide, and lithium hydroxide and aqueous solutions thereof, alkali metal carbonates such as potassium carbonate, sodium carbonate, and lithium carbonate and aqueous solutions thereof, alkali metal sulfates such as potassium sulfate, sodium sulfate, and lithium sulfate and aqueous solutions thereof, alkali metal phosphates such as potassium phosphate, sodium phosphate, and lithium phosphate and aqueous solutions thereof, alkaline earth metal hydroxides such as calcium hydroxide and magnesium hydroxide and aqueous solutions thereof, and amines such as ammonia and triethylamine.

In the step 2, the condensation reaction is preferably controlled by adjusting the pH of the toner base particle dispersion. It is known that the condensation reaction of the organosilicon compound depends on a pH. It is preferable that the pH when the condensation reaction is performed is appropriately changed depending on the type of organosilicon compound. For example, when methyltriethoxysilane is used as the organosilicon compound, the pH of the aqueous medium is preferably 6.0 or more and 12.0 or less. By adjusting the pH, a height H or a width W of the projection containing the organosilicon polymer can be controlled, the projection being formed on the surface of the toner base particle of the toner particle. Therefore, the effects of the present invention can be more easily obtained. As the acid and the base for adjusting the pH, the acid and the base that can be used in the hydrolysis described above can be used.

Hereinafter, a method of measuring values of physical properties will be described.

<Method of Measuring Weight Average Particle Diameter (D4) and Number Average Particle Diameter (D1) of Toner Particle>

A weight average particle diameter (D4) and a number average particle diameter (D1) of the toner particles are calculated as follows.

A precision particle size distribution measuring apparatus (Coulter Counter Multisizer 3 (registered trademark), manufactured by Beckman Coulter, Inc.) equipped with a 100 μm aperture tube and operated by a pore electrical resistance method is used as a measuring apparatus. Measurement conditions are set and measurement data are analyzed by using the accompanying dedicated software "Beckman Coulter Multisizer 3 Version 3.51" (manufactured by Beckman Coulter, Inc.). The measurement is performed with 25,000 effective measurement channels.

An aqueous electrolyte solution used in the measurement is prepared by dissolving special-grade sodium chloride in ion exchange water to make a concentration of 1.0%. For example, "ISOTON II" (manufactured by Beckman Coulter, Inc.) can be used.

Before the measurement and analysis are performed, the dedicated software is set as follows.

In the "Changing a standard operation method of measurement (SOMME)" screen of the dedicated software, a total count number in a control mode is set to 50,000 particles, the number of measurements is set to 1, and a Kd value is set to a value obtained by using "Standard Particle 10.0 μm" (manufactured by Beckman Coulter, Inc.).

A threshold value and a noise level are automatically set by pressing the "Threshold value/noise level measurement button". In addition, a current is set to 1,600 μA, a gain is set to 2, the aqueous electrolyte solution is set to ISOTON II, and "Aperture tube flush after measurement" is checked.

In the "Setting of conversion from pulse to particle diameter" screen of the dedicated software, a bin interval is set to a logarithmic particle diameter, a particle diameter bin is set to a particle diameter bin of 256, and a particle diameter range is set from 2 μm to 60 μm.

A specific measurement method will be described below.

(1) 200.0 mL of the aqueous electrolyte solution is added to a 250 mL round-bottom glass beaker for exclusive use for the Multisizer 3, the beaker is set in a sample stand, and the mixture is stirred in a counterclockwise direction at 24 rotations/sec with a stirrer rod. Dirt and air bubbles in the aperture tube are removed by the "Flush aperture tube" function of the dedicated software.

(2) 30.0 mL of the aqueous electrolyte solution is added to a 100 mL flat-bottom glass beaker. A dispersant "Contamination N" (a 10% aqueous solution of a neutral detergent for washing a precision measuring apparatus composed of a nonionic surfactant, an anionic surfactant, and an organic builder (pH 7), manufactured by Wako Pure Chemical Industries, Ltd.) is diluted with ion exchange water in an amount of about 3 times by mass, and 0.3 mL of a diluted solution is added to the beaker.

(3) An ultrasonic disperser "Ultrasonic Dispersion System Tetra 150" (manufactured by Nikkaki Bios Co., Ltd.) having an electric power of 120 W and two oscillators having an oscillation frequency of 50 kHz which are built in the ultrasonic disperser in a state where phases are shifted by 180 degrees is prepared. 3.3 L of ion exchange water is added to a water tank of the ultrasonic disperser, and 2.0 mL of the Contamination N is added to the water tank.

(4) The beaker prepared in (2) is set in a beaker fixing hole of the ultrasonic disperser and the ultrasonic disperser is operated. Then, a height position of the beaker is adjusted so that a resonance state of a surface of the aqueous electrolyte solution in the beaker is maximized.

(5) 10 mg of the toner particles are added to the aqueous electrolyte solution a little at a time and are dispersed in the electrolyte solution while irradiating the aqueous electrolyte solution in the beaker set in (4) with ultrasonic waves. Then, an ultrasonic dispersion treatment is further continued for 60 seconds. In the ultrasonic dispersion treatment, a temperature of water in the water tank is appropriately adjusted so as to fall within a range of 10° C. or higher and 40° C. or lower.

(6) The aqueous electrolyte solution prepared in (5) in which the toner particles are dispersed is added dropwise to the round-bottom beaker prepared in (1) set in the sample stand using a pipette to adjust a measurement concentration to 5%. Then, the measurement is performed until the number of particles measured reaches 50,000.

(7) Measurement data are analyzed by the dedicated software attached to the apparatus to calculate a weight average particle diameter (D4) and a number average particle diameter (D1). When a graph/vol % is set by the dedicated software, an "average diameter" displayed on the "Analysis/volume statistical value (arithmetic average)" screen indicates the weight average particle diameter (D4). When a graph/number % is set by the dedicated software, an "average diameter" displayed on the "Analysis/number statistical value (arithmetic average)" screen indicates the number average particle diameter (D1).

[Electrophotographic Photosensitive Member]

<Surface Layer>

In the invention, the surface layer of the electrophotographic photosensitive member contains at least one metal oxide particle among an aluminum oxide particle, a silicon dioxide particle, and a tin oxide particle.

In a case of a laminate type photosensitive layer to be described below, a charge transport layer is a surface layer. In a case of a monolayer type photosensitive layer, the monolayer type photosensitive layer is a surface layer. In addition, in a case where a protective layer to be described below is provided on an upper layer of a photosensitive layer, the protective layer is a surface layer.

A content of the aluminum oxide particle in the surface layer is preferably 5.0 parts by mass or more and 100 parts by mass or less with respect to 100.0 parts by mass of a resin component in the surface layer. The content of the aluminum oxide particle in the surface layer is preferably 5.0 parts by mass or more and more preferably 10.0 parts by mass or more from the viewpoint of further improving filming resistance. The content of the aluminum oxide particle in the surface layer is preferably 100 parts by mass or less and more preferably 40 parts by mass or less from the viewpoint of suppressing appearance defects caused by solid foreign matters.

An average primary particle diameter of the aluminum oxide particles is preferably 0.1 μm or more and 2.0 μm or less. The average primary particle diameter of the aluminum oxide particles is preferably 0.1 μm or more and more preferably 0.3 μm or more from the viewpoint of further improving the filming resistance. The average primary particle diameter of the aluminum oxide particles is preferably 2.0 μm or less and more preferably 1.0 μm or less from the viewpoint of further suppressing an occurrence of transfer memory.

A content of the silicon dioxide particle in the surface layer is preferably 0.5 parts by mass or more and 30 parts by mass or less with respect to 100 parts by mass of the resin component. The content of the silicon dioxide particle in the surface layer is preferably 0.5 parts by mass or more and more preferably 1.0 part by mass or more from the viewpoint of further improving the filming resistance. The content of the silicon dioxide particle in the surface layer is preferably 30 parts by mass or less and more preferably 15 parts by mass or less from the viewpoint of suppressing the appearance defects caused by solid foreign matters.

An average primary particle diameter of the silicon dioxide particles is preferably 5.0 nm or more and 10 μm or less. The average primary particle diameter of the silicon dioxide particles is preferably 10 nm or more and more preferably 100 nm or more from the viewpoint of further improving the filming resistance. The average primary particle diameter of the silicon dioxide particles is preferably 10.0 μm or less and more preferably 5.0 μm or less from the viewpoint of further suppressing the occurrence of transfer memory.

A content of the tin oxide particle in the surface layer is preferably 30 parts by mass or more and 150 parts by mass or less with respect to 100 parts by mass of the resin component. The content of the tin oxide particle in the surface layer is preferably 30 parts by mass or more and more preferably 50 parts by mass or more from the viewpoint of further improving the filming resistance. The content of the tin oxide particle in the surface layer is preferably 150 parts by mass or less and more preferably 100 parts by mass or less from the viewpoint of suppressing the appearance defects caused by solid foreign matters.

An average primary particle diameter of the tin oxide particles is preferably 1.0 nm or more and 300.0 nm or less. The average primary particle diameter of the tin oxide particles is preferably 1.0 nm or more and more preferably 3.0 nm or more from the viewpoint of further improving the filming resistance. The average primary particle diameter of the tin oxide particles is preferably 300 nm or less and more preferably 100 nm or less from the viewpoint of further suppressing the occurrence of transfer memory.

Each of the parts by mass can be verified from a mass of the surface layer, a mass obtained by analyzing the resin component in the surface layer and extracting and detecting metal oxide particles, and the like.

In addition, in a case where the resin component in the surface layer contains a resin to be described below, the resin is referred to as a resin component. In a case where a cured product obtained by polymerizing a composition containing a monomer having a polymerizable functional group is contained, the cured product is referred to as a resin component. In a case where a cured product obtained by polymerization by using a material having a charge transport function as a monomer having a polymerizable functional group is contained, the cured product is referred to as a resin component.

The average primary particle diameter of the metal oxide particles is measured, for example, by the following method. A plurality of metal oxide particles (powder) are used as a measurement sample. An $N_2$ absorption isotherm of the measurement sample is measured at −196° C. The obtained $N_2$ absorption isotherm is evaluated according to Brunauer, Emmett and Teller (BET) method and further according to a t-curve method by De Boer. Therefore, a specific surface area of the measurement sample is calculated. A particle diameter of the measurement sample is calculated from the obtained specific surface area of the measurement sample according to the equation "$d=6/\rho S$". In the equation, d represents a particle diameter of the measurement sample, p represents a density of the measurement sample, and S represents a specific surface area of the measurement sample. The calculated particle diameter of the measurement sample is defined as an average primary particle diameter of the metal oxide particles.

As a separate method of measuring the average primary particle diameter of the metal oxide particles, a method using image measurement can also be used. Specifically, an image of a considerable number of metal oxide particles is captured using a transmission electron microscope to measure primary particle diameters of the metal oxide particles in the image. The average primary particle diameter of the metal oxide particles is calculated by dividing a sum of the measured primary particle diameters by the number of the metal oxide particles.

An example of a method of producing an electrophotographic photosensitive member can include a method in which coating liquids for layers to be described below are prepared and applied on the layers in a desired order, and the coating liquids are dried. In this case, examples of a method of applying a coating liquid can include dip coating, spray coating, ink jet coating, roll coating, die coating, blade coating, curtain coating, wire bar coating, and ring coating. Among them, dip coating is preferable from the viewpoints of efficiency and productivity.

Hereinafter, the respective layers will be described.

<Support>

In the present invention, the electrophotographic photosensitive member includes a support. In the present invention, the support is preferably an electro-conductive support having electro-conductivity. In addition, examples of a shape of the support can include a cylindrical shape, a belt shape, and a sheet shape. Among them, a cylindrical support is preferable. In addition, a surface of the support may be subjected to an electrochemical treatment such as anodization, a blast treatment, or a cutting treatment.

As a material for the support, a metal, a resin, or glass is preferable.

Examples of the metal can include aluminum, iron, nickel, copper, gold, and stainless steel, or alloys thereof. Among them, an aluminum support obtained by using aluminum is preferable.

In addition, electro-conductivity may be imparted to the resin or glass through a treatment such as mixing or coating the resin or glass with an electro-conductive material.

<Electro-Conductive Layer>

In the present invention, an electro-conductive layer may be provided on the support. By providing the electro-conductive layer, scratches or unevenness on the surface of the support can be concealed, or reflection of light on the surface of the support can be controlled.

The electro-conductive layer preferably contains an electro-conductive particle and a resin.

Examples of a material for the electro-conductive particle can include a metal oxide, a metal, and carbon black.

Examples of the metal oxide can include zinc oxide, aluminum oxide, indium oxide, silicon oxide, zirconium oxide, tin oxide, titanium oxide, magnesium oxide, antimony oxide, and bismuth oxide. Examples of the metal can include aluminum, nickel, iron, nichrome, copper, zinc, and silver.

Among them, the metal oxide is preferably used for the electro-conductive particle. In particular, titanium oxide, tin oxide, or zinc oxide is more preferably used for the electro-conductive particle.

In a case where the metal oxide is used for the electro-conductive particle, a surface of the metal oxide may be treated with a silane coupling agent or the like, or the metal oxide may be doped with an element such as phosphorus, aluminum, or niobium or an oxide thereof.

The electro-conductive particle may have a laminate structure having a core particle and a covering layer that covers the core particle. Examples of a material of the core particle can include titanium oxide, barium sulfate, and zinc oxide. Examples of a material for the covering layer can include a metal oxide such as tin oxide or titanium oxide.

In a case where the metal oxide is used for the electro-conductive particle, a volume average particle diameter thereof is preferably 1 nm or more and 500 nm or less, and more preferably 3 nm or more and 400 nm or less.

Examples of the resin can include a polyester resin, a polycarbonate resin, a polyvinyl acetal resin, an acrylic resin, a silicone resin, an epoxy resin, a melamine resin, a polyurethane resin, a phenol resin, and an alkyd resin.

The electro-conductive layer may further contain a masking agent such as silicone oil, a resin particle, or titanium oxide.

An average thickness of the electro-conductive layer is preferably 1 μm or more and 50 μm or less, and particularly preferably 3 μm or more and 40 μm or less.

The electro-conductive layer can be formed by preparing a coating liquid for an electro-conductive layer containing the above-described respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent. Examples of a method for dispersing the electro-conductive particles in the coating liquid for an electro-conductive layer can include methods using a paint shaker, a sand mill, a ball mill, and a liquid collision-type high-speed disperser.

<Undercoat Layer>

In the present invention, an undercoat layer may be provided on the support or the electro-conductive layer. By providing the undercoat layer, a charge injection-inhibiting function can be imparted.

The undercoat layer preferably contains a resin. In addition, the undercoat layer may be formed as a cured film by polymerizing a composition containing a monomer having a polymerizable functional group.

Examples of the resin can include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group included in the monomer having the polymerizable functional group can include an isocyanate group, a block isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

The undercoat layer may further contain an electron transporting substance, a metal oxide, a metal, an electroconductive polymer, and the like, in order to improve electric characteristics. Among them, an electron transporting substance or a metal oxide may be preferably used.

Examples of the electron transporting substance can include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transporting substance having a polymerizable functional group may be used as the electron transporting substance and copolymerized with the above-described monomer having the polymerizable functional group to form an undercoat layer as a cured film.

Examples of the metal oxide can include indium tin oxide, tin oxide, indium oxide, titanium oxide, zinc oxide, aluminum oxide, and silicon dioxide. Examples of the metal can include gold, silver, and aluminum.

The surface of the metal oxide may be treated with a silane coupling agent or the like, or the metal oxide may be doped with an element such as phosphorus, aluminum, or niobium or an oxide thereof.

In addition, the undercoat layer may further contain an additive.

An average thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for an undercoat layer containing the above-described respective materials and a solvent, forming a coating film thereof, and drying and/or curing the coating film. Examples of the solvent used in the coating liquid can include an alcohol-based solvent, a ketone-based solvent, an ether-based solvent, an ester-based solvent, and an aromatic hydrocarbon-based solvent.

<Photosensitive Layer>

A photosensitive layer of the electrophotographic photosensitive member is mainly classified into (1) a laminate type photosensitive layer and (2) a monolayer type photosensitive layer. (1) The laminate type photosensitive layer includes a charge generation layer containing a charge generating substance and a charge transport layer containing a charge transporting substance. (2) The monolayer type photosensitive layer includes a photosensitive layer containing both a charge generating substance and a charge transporting substance.

(1) Laminate Type Photosensitive Layer

The laminate type photosensitive layer includes a charge generation layer and a charge transport layer.

(1-1) Charge Generation Layer

The charge generation layer preferably contains a charge generating substance and a resin.

Examples of the charge generating substance can include an azo pigment, a perylene pigment, a polycyclic quinone pigment, an indigo pigment, and a phthalocyanine pigment. Among them, an azo pigment or a phthalocyanine pigment is preferable. Among the phthalocyanine pigments, an oxytitanium phthalocyanine pigment, a chlorogallium phthalocyanine pigment, or a hydroxygallium phthalocyanine pigment is preferable.

A content of the charge generating substance in the charge generation layer is preferably 40% by mass or more and 85% by mass or less, and more preferably 60% by mass or more and 80% by mass or less, with respect to a total mass of the charge generation layer.

Examples of the resin can include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferable.

In addition, the charge generation layer may further contain an additive such as an antioxidant or an ultraviolet absorber. Specific examples thereof can include a hindered phenol compound, a hindered amine compound, a sulfur compound, a phosphorus compound, and a benzophenone compound.

An average thickness of the charge generation layer is preferably 0.1 μm or more and 1.0 μm or less, and more preferably 0.15 μm or more and 0.4 μm or less.

The charge generation layer can be formed by preparing a coating liquid for a charge generation layer containing the above-described respective materials and a solvent, forming a coating film thereof, and drying the coating film. Examples of the solvent used in the coating liquid can include an alcohol-based solvent, a sulfoxide-based solvent, a ketone-based solvent, an ether-based solvent, an ester-based solvent, and an aromatic hydrocarbon-based solvent.

(1-2) Charge Transport layer

The charge transport layer preferably contains a charge transporting substance and a resin.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable.

A content of the charge transporting substance in the charge transport layer is preferably 25% by mass or more and 70% by mass or less, and more preferably 30% by mass or more and 55% by mass or less, with respect to a total mass of the charge transport layer.

Examples of the resin can include a polyester resin, a polycarbonate resin, an acrylic resin, and a polystyrene resin. Among them, a polycarbonate resin or a polyester resin is preferable. As the polyester resin, a polyarylate resin is particularly preferable.

A content ratio (mass ratio) of the charge transporting substance to the resin is preferably 4:10 to 20:10 and more preferably 5:10 to 12:10.

In addition, the charge transport layer may also contain additives such as an antioxidant, an ultraviolet absorber, a plasticizer, a leveling agent, a lubricity imparting agent, and an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, an alumina particle, and a boron nitride particle.

An average thickness of the charge transport layer is preferably 5 μm or more and 50 μm or less, more preferably 8 μm or more and 40 μm or less, and particularly preferably 10 μm or more and 17 μm or less.

The charge transport layer can be formed by preparing a coating liquid for a charge transport layer containing the above-described respective materials and a solvent, forming a coating film thereof, and drying the coating film. Examples of the solvent used in the coating liquid can include an alcohol-based solvent, a ketone-based solvent, an ether-based solvent, an ester-based solvent, and an aromatic hydrocarbon-based solvent. Among these solvents, an ether-based solvent or an aromatic hydrocarbon-based solvent is preferable.

In a case where the charge transport layer is the surface layer, the charge transport layer contains at least one metal oxide particle among an aluminum oxide particle, a silicon dioxide particle, and a tin oxide particle as described above.

(2) Monolayer Type Photosensitive Layer

The monolayer type photosensitive layer can be formed by preparing a coating liquid for a photosensitive layer containing a charge generating substance, a charge transporting substance, a resin, and a solvent, forming a coating film thereof, and drying the coating film. Examples of materials of the charge generating substance, the charge transporting substance, and the resin are the same as in the "(1) Laminate Type Photosensitive Layer".

In a case where the monolayer type photosensitive layer is the surface layer, the monolayer type photosensitive layer contains at least one metal oxide particle among an aluminum oxide particle, a silicon dioxide particle, and a tin oxide particle as described above.

<Protective Layer>

The protective layer preferably contains a charge transporting substance and a resin.

Examples of the resin can include a polyester resin, an acrylic resin, a phenoxy resin, a polycarbonate resin, a polystyrene resin, a phenol resin, a melamine resin, and an epoxy resin. Among them, a polycarbonate resin, a polyester resin, or an acrylic resin is preferable.

Examples of the charge transporting substance can include a polycyclic aromatic compound, a heterocyclic compound, a hydrazone compound, a styryl compound, an enamine compound, a benzidine compound, a triarylamine compound, and a resin having a group derived from these substances. Among them, a triarylamine compound or a benzidine compound is preferable.

In addition, in the protective layer, a resin film may also be formed by a cured product by polymerizing a composition containing a monomer having a polymerizable functional group. Examples of the reaction in this case can include a thermal polymerization reaction, a photopolymerization reaction, and a radiation polymerization reaction. Examples of the polymerizable functional group included in the monomer having the polymerizable functional group can include an acrylic group and a methacrylic group. A resin film may also be formed by a cured product obtained by polymerization by using a material having a charge transport function as a monomer having a polymerizable functional group.

The protective layer may also contain additives such as an antioxidant, an ultraviolet absorber, a plasticizer, a leveling agent, a lubricity imparting agent, and an abrasion resistance improver. Specific examples thereof can include a hindered phenol compound, a hindered amine compound, a sulfur compound, a phosphorus compound, a benzophenone compound, a siloxane-modified resin, silicone oil, a fluorine resin particle, a polystyrene resin particle, a polyethylene resin particle, a silica particle, an alumina particle, and a boron nitride particle.

An average thickness of the protective layer is preferably 0.5 μm or more and 10 μm or less, and more preferably 1 μm or more and 7 μm or less.

The protective layer can be formed by preparing a coating liquid for a protective layer containing the above-described respective materials and a solvent, forming a coating film thereof, and drying and/or curing the coating film. Examples of the solvent used in the coating liquid can include an alcohol-based solvent, a ketone-based solvent, an ether-based solvent, a sulfoxide-based solvent, an ester-based solvent, and an aromatic hydrocarbon-based solvent.

In a case where the electrophotographic photosensitive member includes a protective layer, the protective layer contains at least one metal oxide particle among an aluminum oxide particle, a silicon dioxide particle, and a tin oxide particle as described above.

[Process Cartridge and Electrophotographic Apparatus]

A process cartridge according to the present invention includes a developing unit including the toner described above and the electrophotographic photosensitive member described above, and is detachably attachable to a main body of an electrophotographic apparatus.

In addition, the electrophotographic apparatus according to the present invention includes the process cartridge.

FIGURE illustrates an example of a schematic configuration of the electrophotographic apparatus including the process cartridge provided with the electrophotographic photosensitive member.

Reference numeral 1 represents a cylindrical electrophotographic photosensitive member, and the cylindrical electrophotographic photosensitive member is rotatably driven about a shaft 2 in the arrow direction at a predetermined peripheral velocity. A surface of the electrophotographic photosensitive member 1 is charged to have a predetermined positive or negative potential by a charging unit 3. Although a roller charging method using a roller type charging member is illustrated in FIGURE, a charging method such as a corona charging method, a proximity charging method, or an injection charging method may also be adopted. The surface of the charged electrophotographic photosensitive member 1 is irradiated with exposure light 4 emitted from an exposing unit (not illustrated), and an electrostatic latent image corresponding to target image information is formed on the surface of the electrophotographic photosensitive member 1. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transfer unit 6. The transfer material 7 onto which the toner image is transferred is conveyed to a fixing unit 8, is subjected to a treatment for fixing the toner image, and is printed out to the outside of the electrophotographic apparatus. The electrophotographic apparatus may also include a cleaning unit 9 for removing attached materials such as the toner remaining on the surface of the electrophotographic photosensitive member 1 after the transfer. In addition, a so-called cleaner-less system configured to remove the attached materials by the developing unit 5 or the like without separately providing the cleaning unit 9 may be used. The electrophotographic apparatus may also include an antistatic mechanism for an antistatic treatment of the surface of the electrophotographic photosensitive member 1 by pre-exposure light 10 from a pre-exposing unit (not illustrated). In addition, a guiding unit 12 such as a rail may be provided for detachably attaching a process cartridge 11 according to the present invention to the main body of the electrophotographic apparatus.

EXAMPLES

The present invention will be described in detail with reference to the following examples. However, the present invention is not limited by these examples. Hereinafter, a toner and a method of producing a toner will be described. The "parts" and "%" in examples and comparative examples are on a mass basis unless specifically indicated otherwise.

Production Example of Toner Base Particle Dispersion (Preparation of Aqueous Medium) 11.2 parts of sodium phosphate (dodecahydrate) were injected to a reaction vessel in which 390.0 parts of ion exchange water were added, and the temperature of the mixture was held at 65° C. for 1.0 hour while purging the reaction vessel with nitrogen. The mixture was stirred at 12,000 rpm using a T. K. homomixer (manufactured by Tokushu Kika Kogyo Co., Ltd.). An aqueous calcium chloride solution prepared by dissolving 7.4 parts of calcium chloride (dihydrate) in 10.0 parts of ion exchange water was collectively injected to the reaction vessel while maintaining the stirring. Further, 1.0 mol/L hydrochloric acid was injected to the aqueous medium in the reaction vessel to adjust a pH to 6.0, thereby preparing an aqueous medium containing a dispersion stabilizer.

(Preparation of Polymerizable Monomer Composition)

The following materials were prepared.

| | |
|---|---|
| Styrene | 60.0 parts |
| C.I. Pigment Blue 15:3 | 6.3 parts |

These materials were injected to an attritor (manufactured by NIPPON COKE & ENGINEERING CO., LTD.) and further dispersed at 220 rpm for 5.0 hours by using a zirconia particle having a diameter of 1.7 mm, thereby preparing a coloring agent dispersion in which a pigment is dispersed.

Next, the following materials were prepared.

| | |
|---|---|
| Styrene | 10.0 parts |
| n-Butyl acrylate | 30.0 parts |
| Polyester resin (Polycondensation product of terephthalic acid and propylene oxide 2 mol adduct of bisphenol A, weight average molecular weight Mw = 10,000, acid value: 8.2 mgKOH/g) | 5.0 parts |
| Paraffin wax (trade name: HNP9, manufactured by NIPPON SEIRO CO., LTD., melting point: 76° C.) | 6.0 parts |

These materials were added to the coloring agent dispersion. Thereafter, the temperature was held at 65° C., and the mixture was uniformly dissolved and dispersed at 500 rpm using the T. K. homomixer, thereby preparing a polymerizable monomer composition.

(Granulation Step)

The polymerizable monomer composition was injected to the aqueous medium and 8.0 parts of t-butyl peroxypivalate as a polymerization initiator were added while keeping the temperature of the aqueous medium at 70° C. and a rotation speed of a stirring apparatus at 12,000 rpm. The resultant was granulated as it was with the stirring apparatus for 10 minutes while maintaining the rotation speed at 12,000 rpm.

(Polymerization Step)

The stirring apparatus was changed from a high-speed stirring apparatus to a stirrer equipped with propeller stirring blades, and the temperature was held at 70° C. and the polymerization was performed for 5.0 hours while stirring the mixture at 200 rpm. Further, a polymerization reaction was performed by increasing the temperature to 85° C. and performing heating for 2.0 hours. In addition, a residual monomer was removed by increasing the temperature to 98° C. and performing heating for 3.0 hours, and ion exchange water was added to adjust a concentration of the toner base particle in the dispersion to 30.0%, thereby obtaining a toner base particle dispersion in which the toner base particles are dispersed.

A number average particle diameter (D1) of the toner base particles was 6.2 μm and a weight average particle diameter (D4) of the toner base particles was 6.9 μm.

Production Example of Organosilicon Compound Liquid

The following materials were prepared.

| | |
|---|---|
| Ion exchange water | 70.0 parts |
| Methyltriethoxysilane | 30.0 parts |

These materials were weighed in a 200 mL beaker, and a pH was adjusted to 3.5 with 10% hydrochloric acid. Thereafter, the mixture was stirred for 1.0 hour while heating to 60° C. in a water bath to prepare an organosilicon compound liquid.

Production Example of Polyvalent Acid Metal Salt Particle

The following materials were prepared.

| | |
|---|---|
| Ion exchange water | 100.0 parts |
| Sodium phosphate (dodecahydrate) | 8.5 parts |
| After these materials were mixed with each other, the following materials were added while stirring the mixture at 10,000 rpm using the T.K. homomixer (manufactured by Tokushu Kika Kogyo Co., Ltd.)at room temperature. | |
| Zirconium lactate ammonium salt (trade name: ZC-300, manufactured by Matsumoto Fine Chemical Co., Ltd.) | 60.0 parts (equivalent to 7.2 parts as zirconium lactate ammonium salt) |

Further, 1.0 mol/L hydrochloric acid was added to adjust the pH to 7.0. The temperature was adjusted to 25° C. and a reaction was performed for 1 hour while maintaining the stirring.

Thereafter, a solid content was extracted by centrifugal separation. Subsequently, a step of re-dispersing the resultant in ion exchange water and extracting the solid content by centrifugal separation was repeated 3 times to remove ions such as sodium. The resultant was dispersed again in ion exchange water and dried in a spray dry manner to obtain a zirconium phosphate compound particle having a number average particle diameter of 124 nm.

Production Example of Toner Particle

<Toner Particle 1>

(Step of Forming Projection)

The sample in the reaction vessel was weighed and mixed using propeller stirring blades.

| | |
|---|---|
| Toner base particle dispersion | 500.0 parts |
| Organosilicon compound liquid | 35.0 parts |

Next, a pH of the obtained mixed liquid was adjusted to 9.5 by using a 1.0 mol/L NaOH aqueous solution, the temperature of the mixed liquid was set to 50° C., and then the temperature was held for 1.0 hour while performing mixing using the propeller stirring blades.

(Step of Attaching Polyvalent Acid Metal Salt Particle)

Next, the following materials were prepared.

| | |
|---|---|
| 44% aqueous solution of titanium lactate (TC-310, manufactured by Matsumoto Fine Chemical Co., Ltd.) | 3.2 parts (equivalent to 1.4 parts as titanium lactate) |
| Organosilicon compound liquid | 10.0 parts |

These materials were mixed with each other in the reaction vessel, and then a pH of the obtained mixed liquid was adjusted to 9.5 using a 1.0 mol/L NaOH aqueous solution and held for 4.0 hours. After the temperature was lowered to 25° C., the pH was adjusted to 1.5 with 1.0 mol/L hydrochloric acid, and the mixture was stirred for 1.0 hour and then filtered while washing the mixture with ion exchange water. The obtained powder was dried in a thermostatic bath and then the dried powder was classified by a wind powder classifier to obtain a toner particle 1.

A number average particle diameter (D1) of the toner particles 1 was 6.2 μm and a weight average particle diameter (D4) of the toner particles 1 was 6.9 As a result of observing the toner particle 1 by TEM-EDX, it was observed that a projection containing an organosilicon polymer was formed on a surface of the toner particle and titanium was present on a surface of the projection. A height H of the projection was 60 nm. In addition, ions derived from titanium phosphate were detected by analyzing the toner particle 1 by TOF-SIMS.

The titanium phosphate compound described above is a reaction product of titanium lactate and sodium phosphate in the aqueous medium or phosphoric acid ions derived from calcium phosphate.

<Toner Particle 2>

Step of Attaching Polyvalent Acid Metal Salt Particle

The sample in the reaction vessel was weighed and mixed using propeller stirring blades.

| | |
|---|---|
| Toner base particle dispersion | 500.0 parts |
| 44% aqueous solution of titanium lactate (TC-310, manufactured by Matsumoto Fine Chemical Co., Ltd.) | 3.2 parts (equivalent to 1.4 parts as titanium lactate) |
| Organosilicon compound liquid | 10.0 parts |

Next, a pH of the obtained mixed liquid was adjusted to 9.5 using a 1.0 mol/L NaOH aqueous solution and held for 5.0 hours. After the temperature was lowered to 25° C., the pH was adjusted to 1.5 with 1.0 mol/L hydrochloric acid, and the mixture was stirred for 1.0 hour and then filtered while washing the mixture with ion exchange water. The obtained powder was dried in a thermostatic bath and then the dried powder was classified by a wind powder classifier to obtain a toner particle 2.

A number average particle diameter (D1) of the toner particles 2 was 6.2 μm and a weight average particle diameter (D4) of the toner particles 2 was 6.9 μm. As a result of observing the toner particle 2 by TEM-EDX, an organosilicon polymer was present on a surface of the toner particle, but a projection was not formed. In addition, it was observed that titanium was present on a surface of a toner. Further, ions derived from titanium phosphate were detected by analyzing the toner particle 2 by TOF-SIMS.

The titanium phosphate compound described above is a reaction product of titanium lactate and sodium phosphate in the aqueous medium or phosphoric acid ions derived from calcium phosphate.

<Toner Particle 3>

In the production example of the toner particle 2, 11.7 parts of a zirconium lactate ammonium salt (ZC-300, manufactured by Matsumoto Fine Chemical Co., Ltd.) (equivalent to 1.4 parts as zirconium lactate ammonium salt) were used instead of 3.2 parts of the 44% aqueous solution of titanium lactate. A toner particle 3 was obtained in the same manner as that of the production example of the toner particle 2 except for this.

A number average particle diameter (D1) of the toner particles 3 was 6.2 μm and a weight average particle diameter (D4) of the toner particles 3 was 6.9 As a result of observing the toner particle 3 by TEM-EDX, an organosilicon polymer was present on a surface of the toner particle, but a projection was not formed. In addition, it was observed that zirconium was present on a surface of a toner. Further, ions derived from zirconium phosphate were detected by analyzing the toner particle 3 by TOF-SIMS.

The zirconium phosphate compound described above is a reaction product of a zirconium lactate ammonium salt and sodium phosphate in the aqueous medium or phosphoric acid ions derived from calcium phosphate.

<Toner Particle 4>

The sample in the reaction vessel was weighed and mixed using propeller stirring blades.

| | |
|---|---|
| Toner base particle dispersion | 500.0 parts |

Next, a pH was adjusted to 1.5 with 1.0 mol/L hydrochloric acid while maintaining the temperature at 25° C., the mixture was stirred for 1.0 hour, and then the mixture was filtered while washing the mixture with ion exchange water. The obtained powder was dried in a thermostatic bath and then the dried powder was classified by a wind powder classifier to obtain a toner particle 4.

<Toner Particle 5>

A toner particle 5 was obtained in the same manner as that of the production example of the toner particle 2, except that the 44% aqueous solution of titanium lactate was not added.

A number average particle diameter (D1) of the toner particles 5 was 6.2 μm and a weight average particle diameter (D4) of the toner particles 5 was 6.9 As a result of observing the toner particle 5 by TEM-EDX, an organosilicon polymer was present on a surface of the toner particle, but a projection was not formed. In addition, metal elements were absent on a surface of a toner. Further, as a result of analyzing the toner particle 5 by TOF-SIMS, ions derived from a polyvalent acid metal salt were not detected.

<Method of Producing Toner>

<Toners 1, 2, 3, and 5>

The toner particles 1, 2, 3, and 5 were used as toners 1, 2, 3, and 5, respectively.

<Toner 4>

The following materials were prepared.

| | |
|---|---|
| Toner particle 4 | 100.0 parts |
| Hydrophobic silica fine particle (hexamethyldisilazane treatment: number average particle diameter 12 nm) | 1.0 part |
| Polyvalent acid metal salt particle | 2.0 parts |

These materials were injected to SUPERMIXER PICCOLO SMP-2 (manufactured by KAWATA MFG. CO., LTD.) and were mixed with each other at 3,000 rpm for 20 minutes. Thereafter, a toner 4 was obtained by sieving the mixture with a mesh having openings (150 μm).

A number average particle diameter (D1) of the toner 4 was 6.2 μm and a weight average particle diameter (D4) of the toner 4 was 6.9 As a result of observing the toner 4 by TEM-EDX, an organosilicon polymer was absent on the surface of the toner particle. In addition, it was observed that zirconium was present on a surface of a toner. Ions derived from zirconium phosphate were detected by analyzing the toner 4 by TOF-SIMS.

<Method of Calculating Ratios of M1 and M2 of Metal Elements M by X-Ray Photoelectron Spectrometry>

Treatment (a)

Each of the toners 1 to 5 produced as described above was subjected to the following treatment (a) to obtain a toner (a) corresponding to each toner.

160 g of sucrose (manufactured by Kishida Chemical Co., Ltd.) was added to 100 mL of ion exchange water and was dissolved while heating the ion exchange water to prepare a 61.5% aqueous solution of sucrose. 31.0 g of the concentrated sucrose solution and 6 g of a 10% by mass aqueous solution for a neutral detergent for washing a precision measuring apparatus (pH 7) (trade name: Contamination N, manufactured by Wako Pure Chemical Industries, Ltd., composed of a nonionic surfactant, an anionic surfactant, and an organic builder) were added to a centrifugation tube to prepare a dispersion. 1.0 g of the toner produced as described above was added to the dispersion and agglomerates of the toner were broken up with a spatula or the like. The centrifugation tube was shaken at 300 spm (strokes per min) for 20 minutes with a shaker. After the shaking was performed, the solution was transferred to a glass tube (50 mL) for a swing rotor and was separated at 3,500 rpm for 30 minutes with a centrifugal separator. After visually confirming that the toner and the aqueous solution were sufficiently separated from each other, the toner separated in the uppermost layer was collected by a spatula or the like. The collected toner was filtered with a vacuum filter and then the filtered toner was dried in a dryer for 1 hour or longer. The dried toner was crushed with a spatula to produce a toner (a) corresponding to each toner.

The toners 1 to 5 produced as described above and the toner (a) corresponding to each of the toners 1 to 5 were measured under the following conditions by X-ray photoelectron spectrometry to calculate ratios of M1 (atomic %) and M2 (atomic %) of metal elements M.

Measuring apparatus: X-ray photoelectron spectrometer, Quantum 2000 (manufactured by ULVAC-PHI, INCORPORATED)

X-ray source: monochrome Al Kα

Xray Setting: 100 μmφ (25 W (15 KV))

Photoelectron take-off angle: 45 degrees

Neutralization condition: using both neutralization gun and ion gun

Analysis region: 300×200 μm

Pass Energy: 58.70 eV

Step size: 0.125 eV

Analytic software: Multipak (manufactured by Physical Electronics Inc. (PHI))

Here, for example, a peak of Ti 2p (B.E.452 to 468 eV) was used to calculate a quantitative value of a Ti atom. The quantitative value of the obtained Ti element was defined as M1 (atomic %).

Physical properties of the toners 1 to 5 are shown in Table 1.

TABLE 1

| | Polyvalent acid metal salt | Organosilicon polymer | Projection | Height H of projection (nm) | M1 (atomic %) | M2/M1 |
|---|---|---|---|---|---|---|
| Toner 1 | Ti phosphate | Presence | Presence | 60 | 3.3% | 0.99 |
| Toner 2 | Ti phosphate | Presence | Absence | — | 2.7% | 0.99 |
| Toner 3 | Zr phosphate | Presence | Absence | — | 2.7% | 0.99 |
| Toner 4 | Zr phosphate | Absence | Absence | — | 0.2% | 0.50 |
| Toner 5 | Absence | Presence | Absence | — | — | — |

<Production of Electrophotographic Photosensitive Member>

(Production Example of Electrophotographic Photosensitive Member 1)

An aluminum cylinder (JIS-A3003, aluminum alloy) having a diameter of 24 mm and a length of 257.5 mm was used as s support (electro-conductive support).

(Formation of Electro-Conductive Layer)

Next, the following materials were prepared.

[Preparation of Coating Liquid for Electro-Conductive Layer]

(Coating Liquid 1 for Electro-Conductive Layer)

Next, the following materials were prepared.

| | |
|---|---|
| Titanium oxide ($TiO_2$) particle coated with oxygen-deficient tin oxide ($SnO_2$) as metal oxide particle | 214 parts |
| Phenol resin (trade name: Plyophen J-325, manufactured by DIC Corporation, resin solid content: 60% by mass) as binding material | 132 parts |
| 1-Methoxy-2-propanol as solvent | 98 parts |

These materials were added to a sand mill using 450 parts of glass beads having a diameter of 0.8 mm, and a dispersion treatment was performed under conditions (a rotation speed: 2,000 rpm, a dispersion treatment time: 4.5 hours, and a cooling water setting temperature: 18° C.), thereby obtaining a dispersion.

In this case, the glass beads were removed by a mesh (openings: 150 μm) and then filtering was performed using a filter having a fine pore diameter of 5 thereby obtaining the dispersion.

In addition, a silicone resin particle (trade name: TOSPEARL 120, manufactured by Momentive Performance Materials Japan LLC, average particle diameter: 2 μm) as a surface roughness-imparting agent was added to the dispersion. An addition amount of the silicone resin particle in this case was set to 10% by mass with respect to a total mass of the metal oxide particle and the binding material in the dispersion after the glass beads were removed. In addition, silicone oil (trade name: SH28PA, manufactured by Dow Corning Toray Co., Ltd.) as a leveling agent was added to the dispersion and the mixture was stirred so that a content of the silicone oil was 0.01% by mass with respect to the total mass of the metal oxide particle and the binding material in the dispersion, thereby preparing a coating liquid for an electro-conductive layer.

The coating liquid for an electro-conductive layer was dipped and applied onto the support to form a coating film, and the obtained coating film was dried and thermally cured at 150° C. for 30 minutes, thereby forming an electro-conductive layer having a thickness of 30 μm.

(Formation of Undercoat Layer)

15 parts of an N-methoxymethylated 6-nylon resin (Toresin EF-30T, manufactured by Nagase ChemteX Corporation) and 5 parts of a copolymer nylon resin (Amilan CM8000, manufactured by Toray Co., Ltd.) were dissolved in a mixed solvent of 220 parts of methanol and 110 parts of 1-butanol, thereby preparing a coating liquid for an undercoat layer. The coating liquid for an undercoat layer was dipped and applied onto the support to form a coating film, and the coating film was heated at 100° C. for 10 minutes, thereby forming an undercoat layer having a thickness of 0.65 μm.

(Formation of Charge Generation Layer)

Next, the following materials were prepared.

| | |
|---|---|
| Hydroxy gallium phthalocyanine crystal (charge generating substance) in crystal form with peaks at Bragg angles (2θ ± 0.2°) of 7.5°, 9.9°, 12.5°, 16.3°, 18.6°, 25.1°, and 28.3° in CuKα characteristic X-ray diffraction | 10 parts |
| Compound represented by Structural Formula (A) | 0.1 parts |
| Polyvinyl butyral (trade name: S-LEC BX-1, manufactured by SEKISUI CHEMICAL CO., LTD.) | 5 parts |
| Cyclohexanone | 250 parts |

These materials were added to a sand mill using glass beads having a diameter of 0.8 mm and were subjected to a dispersion treatment for 1.5 hours. Next, a coating liquid for a charge generation layer was prepared by adding 250 parts of ethyl acetate thereto. The obtained coating liquid for a charge generation layer was dipped and applied onto the undercoat layer to form a coating film, and then the coating film was dried at 100° C. for 10 minutes, thereby forming a charge generation layer having a thickness of 0.17 μm. Measurement of X-ray diffraction was performed under the following conditions.

(A)

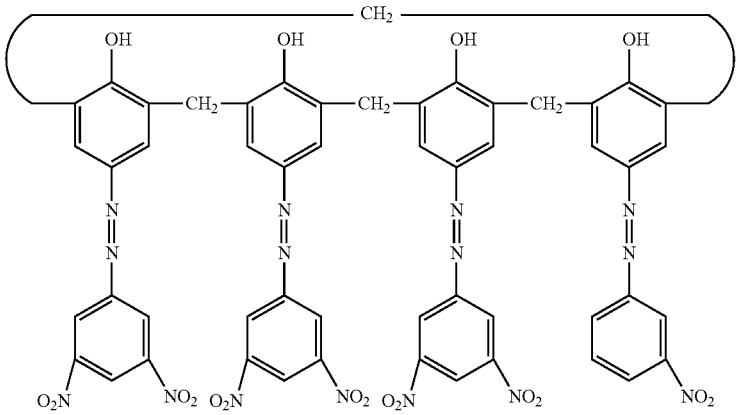

[Powder X-Ray Diffraction Measurement]

Used measuring machine: X-ray diffractometer RINT-TTRII, manufactured by Rigaku Corporation X-ray tube bulb: Cu Tube voltage: 50 KV Tube current: 300 mA Scanning method: 2θ/θ scan Scanning rate: 4.0°/min Sampling interval: 0.02°

Start angle (2θ): 5.0°

Stop angle (2θ): 40.0°

Attachment: standard sample holder

Filter: not used

Incident monochrome: used

Counter monochromator: not used

Divergence slit: open

Divergence longitudinal restriction slit: 10.00 mm

Scattering slit: open

Light-receiving slit: open

Flat monochromator: used

Counter: scintillation counter (Formation of Charge Transport layer)

The following materials were prepared.

| | |
|---|---|
| Compound represented by Structural Formula (CTM-1) | 4 parts |
| Compound represented by Structural Formula (CTM-2) | 4 parts |
| Bisphenol Z polycarbonate (trade name: PCZ-400, manufactured by Mitsubishi Gas Chemical Company, Inc.) | 10 parts |

These materials were dissolved in a mixed solvent of 40 parts of dimethoxymethane and 60 parts of chlorobenzene, thereby preparing a coating liquid for a hole transport layer (charge transport layer). The obtained coating liquid was dipped and applied onto the charge generation layer to form a coating film, and then the coating film was dried at 125° C. for 30 minutes, thereby forming a charge transport layer having a thickness of 15 μm.

(CTM-1)

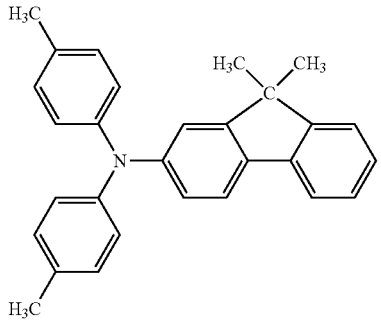

(CTM-2)

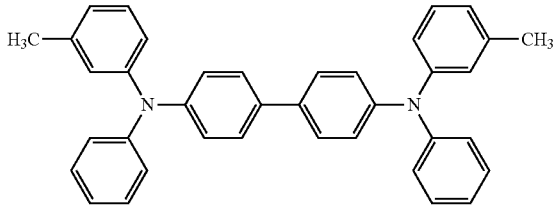

(Formation of Protective Layer)

The following materials were prepared.

| | |
|---|---|
| Compound represented by Structural Formula (H-1) | 43 parts by mass |
| Trimethylolpropane triacrylate (trade name: KAYARAD TMPTA, manufactured by Nippon Kayaku Co., Ltd.) | 21 parts by mass |
| Caprolactone modified dipentaerythritol hexaacrylate (trade name: KAYARAD DPCA-120, manufactured by Nippon Kayaku Co., Ltd.) | 21 parts by mass |
| Mixture of acrylic group-containing polyester modified polydimethyl siloxane and propoxy modified-2-neopentyl glycol diacrylate (trade name: BYK-UV3570, manufactured by BYK-Chemie GmbH) | 0.1 parts by mass |
| 1-Hydroxycyclohexyl phenyl ketone (trade name: Irgacure 184, manufactured by Ciba Specialty Chemicals, Inc.) | 4 parts by mass |
| Aluminum oxide particle (trade name: Sumi Corundum AA-03, manufactured by Sumitomo Chemical Co., Ltd.) | 4.25 parts by mass |

-continued

| | |
|---|---|
| Phosphoric acid-based wetting dispersant (trade name: Superdine V201, manufactured by TAKEMOTO OIL & FAT Co., Ltd.) | 1.0 part by mass |

A coating liquid 1 for a protective layer was prepared by dissolving these materials in 566 parts by mass of tetrahydrofuran. The obtained coating liquid was dipped and applied onto the charge transport layer to form a coating film, and the coating film was dried in a natural dry manner for 20 minutes and then was subjected to light irradiation under conditions (a metal halide lamp: 160 W/cm, an irradiation distance: 120 mm, an irradiation intensity: 500 mW/cm$^2$, and an irradiation time: 60 seconds) to be cured. Further, the coating film was dried at 130° C. for 20 minutes to form a protective layer having a thickness of 4.9 μm.

(H-1)

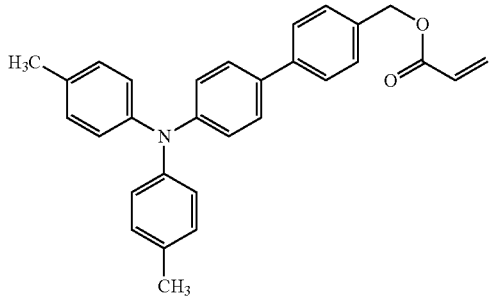

An electrophotographic photosensitive member 1 was produced as described above.

Production Examples of Electrophotographic Photosensitive Members 2 to 5

Each of electrophotographic photosensitive members 2 to 5 was produced in the same manner as that of the production example of the electrophotographic photosensitive member 1, except that the amount of the aluminum oxide particle was changed as shown in Table 2.

Production Example of Electrophotographic Photosensitive Member 6

An electrophotographic photosensitive member 6 was produced in the same manner as that of the production example of the electrophotographic photosensitive member 1, except that the formation of the protective layer was changed as described below.

(Formation of Protective Layer in Production of Electrophotographic Photosensitive Member 6)

(Production of Surface-Treated Metal Oxide Particle)

The following materials were prepared.

| | |
|---|---|
| Tin oxide particle (average primary particle diameter: 20 nm, volume resistivity: $1.1 \times 10^5$ Ω, manufactured by CIK NanoTek Corporation) as metal oxide particle | 100 parts by mass |
| Methacrylic acid 3-(trimethoxysilyl)propyl | 30 parts by mass |

These materials were mixed with 150 parts by mass of toluene and 150 parts by mass of isopropyl alcohol, and the mixture was added to a sand mill together with zirconia beads at about 40° C. and then was stirred at a rotation speed of 1,500 rpm. Further, the treated mixture was taken out, injected to a Henschel mixer, and stirred at a rotation speed of 1,500 rpm for 15 minutes, and then the mixture was dried at 120° C. for 3 hours, thereby obtaining a surface-treated tin oxide particle.

Next, the following materials were prepared.

| | |
|---|---|
| Surface-treated tin oxide particle | 33 parts by mass |
| Compound represented by Structural Formula (H-2) | 100 parts by mass |
| Compound represented by Structural Formula (CTM-3) | 10 parts by mass |
| Polymerization initiator (trade name: Irgacure 819, manufactured by BASF Japan Ltd.) | 10 parts by mass |
| 2-Mercaptobenzoxazole | 10 parts by mass |

These materials were mixed with 320 parts by mass of 2-butanol and 80 parts by mass of tetrahydrofuran, and the mixture was stirred and sufficiently dissolved and dispersed, thereby preparing a coating liquid for a protective layer. The obtained coating liquid was dipped and applied onto the charge transport layer and the coating liquid was irradiated with ultraviolet rays for 1 minute using a metal halide lamp to form a protective layer having a dried film thickness of 3.0 μm, thereby producing the electrophotographic photosensitive member 6.

(H-2)

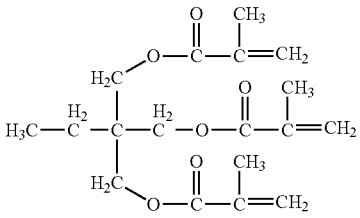

(CTM-3)

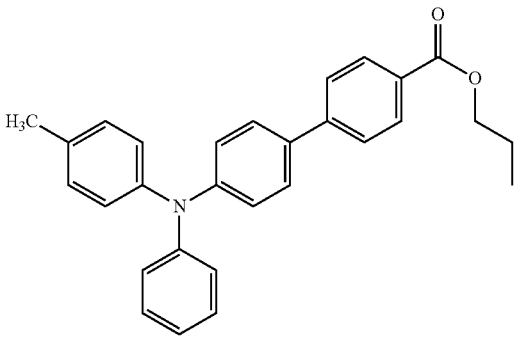

Production Examples of Electrophotographic Photosensitive Members 7 to 10

Each of electrophotographic photosensitive members 7 to 10 was produced in the same manner as that of the production example of the electrophotographic photosensitive member 6, except that the amount of the surface-treated tin oxide particle was changed as shown in Table 2.

Production Example of Electrophotographic Photosensitive Member 11

An aluminum cylinder (JIS-A3003, aluminum alloy) having a diameter of 24 mm and a length of 257.5 mm was used as s support (electro-conductive support).

In addition, the following materials were prepared.

| | |
|---|---|
| X-form metal-free phthalocyanine (X-form crystal of metal-free phthalocyanine, x-$H_2Pc$) | 3 parts by mass |
| Compound represented by the following Structural Formula (CTM-4) | 50 parts by mass |
| Compound represented by the following Structural Formula (ETM-1) | 50 parts by mass |
| Silicon dioxide particle (average primary particle diameter: 0.012 μm, Rx200, manufactured by Nippon Aerosil Co., Ltd.) | 0.5 parts by mass |
| Bisphenol Z polycarbonate (trade name: PCZ-400, manufactured by Mitsubishi Gas Chemical Company, Inc.) | 100 parts by mass |

These materials were mixed with 800 parts by mass of tetrahydrofuran and added to a ball mill, and the mixture was mixed for 50 hours and dispersed, thereby preparing a coating liquid for a monolayer photosensitive layer. The obtained coating liquid for a monolayer photosensitive layer was dipped and applied onto the support to obtain a coating film, and the obtained coating film was dried at 100° C. for 40 minutes, thereby producing an electrophotographic photosensitive member 11 having a thickness of 30 μm.

(CTM-4)

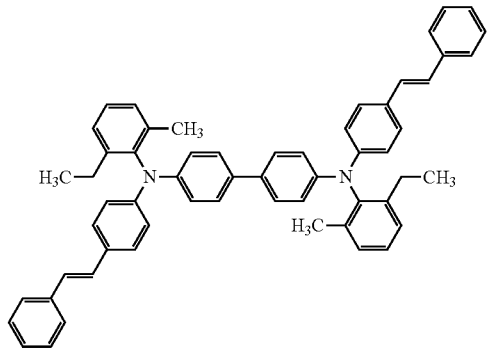

(ETM-1)

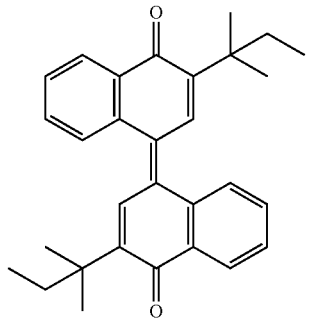

Production Examples of Electrophotographic Photosensitive Members 12 to 15

Each of electrophotographic photosensitive members 12 to 15 was produced in the same manner as that of the production example of the electrophotographic photosensitive member 11, except that the amount of the silicon dioxide particle was changed as shown in Table 2.

Production Example of Electrophotographic Photosensitive Member 16

An electrophotographic photosensitive member 16 was produced in the same manner as that of the production example of the electrophotographic photosensitive member 1, except that the aluminum oxide particle was not used.

TABLE 2

| Electrophotographic photosensitive member | Resin/ parts by mass | Metal oxide/ parts by mass |
|---|---|---|
| Electrophotographic photosensitive member 1 | 85 | 4.25 |
| Electrophotographic photosensitive member 2 | 85 | 8.5 |
| Electrophotographic photosensitive member 3 | 85 | 17 |
| Electrophotographic photosensitive member 4 | 85 | 34 |
| Electrophotographic photosensitive member 5 | 85 | 85 |
| Electrophotographic photosensitive member 6 | 110 | 33 |
| Electrophotographic photosensitive member 7 | 110 | 55 |
| Electrophotographic photosensitive member 8 | 110 | 77 |
| Electrophotographic photosensitive member 9 | 110 | 110 |
| Electrophotographic photosensitive member 10 | 110 | 165 |
| Electrophotographic photosensitive member 11 | 100 | 0.5 |
| Electrophotographic photosensitive member 12 | 100 | 1 |
| Electrophotographic photosensitive member 13 | 100 | 5 |
| Electrophotographic photosensitive member 14 | 100 | 15 |
| Electrophotographic photosensitive member 15 | 100 | 30 |
| Electrophotographic photosensitive member 16 | 85 | 0 |

Examples 1 to 18 and Comparative Examples 1 to 3

The toners 1 to 5 and the electrophotographic photosensitive members 1 to 16 were used and evaluated in combinations shown in Table 3.

Hereinafter, the evaluation method and evaluation criteria of the present invention will be described.

As an image forming apparatus, a laser printer (Color LaserJet Enterprise M552 modified machine) manufactured by Hewlett-Packard Company was used. After a product toner was removed from a cartridge and the inside of the cartridge was cleaned by blowing air, the cartridge was filled with 165 g of the toner of the present invention, and an electrophotographic photosensitive member was replaced with the electrophotographic photosensitive member of the present invention.

The product toner was removed at each of stations for yellow, magenta, and black, yellow, magenta, and black cartridges whose toner residual amount detecting mechanisms were disabled were inserted, and then the evaluation was carried out.

<Evaluation of Image Fogging>

A solid white image with a 0% print percentage was printed out in a glossy paper mode (⅓ speed). A Letter size paper (trade name: HP Brochure Paper 200 g, Glossy, manufactured by Hewlett-Packard Company, basis weight: 200 g/cm$^2$) was used for print out. In addition, the Letter size paper was used by attaching a 75 mm×75 mm paper (trade name: Post-it, manufactured by 3M) to a center position thereof.

The attached paper was removed from the image printed out, and then a whiteness was measured using "REFLECTMETER MODEL TC-6DS" (manufactured by Tokyo Denshoku CO., LTD.). A fogging density (%) was calculated from a difference between a whiteness of a blank part of the image printed out and a whiteness of a transfer paper (a portion from which the attached paper was removed) to evaluate the image fogging. An amber filter was used as a filter.

The evaluation results are shown in Table 3.

TABLE 3

| | Toner | Electrophotographic photosensitive member | Fogging density | Appearance |
|---|---|---|---|---|
| Example 1 | Toner 1 | Electrophotographic photosensitive member 1 | 0.72% | Good |
| Example 2 | Toner 1 | Electrophotographic photosensitive member 2 | 0.56% | Good |
| Example 3 | Toner 1 | Electrophotographic photosensitive member 3 | 0.44% | Good |
| Example 4 | Toner 1 | Electrophotographic photosensitive member 4 | 0.28% | Good |
| Example 5 | Toner 1 | Electrophotographic photosensitive member 5 | 0.23% | Acceptable |
| Example 6 | Toner 1 | Electrophotographic photosensitive member 6 | 0.74% | Good |
| Example 7 | Toner 1 | Electrophotographic photosensitive member 7 | 0.59% | Good |
| Example 8 | Toner 1 | Electrophotographic photosensitive member 8 | 0.43% | Good |
| Example 9 | Toner 1 | Electrophotographic photosensitive member 9 | 0.29% | Good |
| Example 10 | Toner 1 | Electrophotographic photosensitive member 10 | 0.24% | Acceptable |
| Example 11 | Toner 1 | Electrophotographic photosensitive member 11 | 0.69% | Good |
| Example 12 | Toner 1 | Electrophotographic photosensitive member 12 | 0.52% | Good |
| Example 13 | Toner 1 | Electrophotographic photosensitive member 13 | 0.45% | Good |
| Example 14 | Toner 1 | Electrophotographic photosensitive member 14 | 0.30% | Good |
| Example 15 | Toner 1 | Electrophotographic photosensitive member 15 | 0.29% | Acceptable |
| Example 16 | Toner 2 | Electrophotographic photosensitive member 13 | 0.59% | Good |
| Example 17 | Toner 3 | Electrophotographic photosensitive member 13 | 0.79% | Good |
| Example 18 | Toner 4 | Electrophotographic photosensitive member 13 | 1.03% | Good |
| Comparative Example 1 | Toner 5 | Electrophotographic photosensitive member 13 | 1.49% | Good |
| Comparative Example 2 | Toner 4 | Electrophotographic photosensitive member 16 | 1.58% | Good |
| Comparative Example 3 | Toner 5 | Electrophotographic photosensitive member 16 | 2.01% | Good |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-137132, filed Jul. 25, 2019, and Japanese Patent Application No. 2020-113398, filed Jun. 30, 2020, which are hereby incorporated by reference herein in their entirety.

What is claimed is:

1. A process cartridge detachably attachable to a main body of an electrophotographic apparatus, the process cartridge comprising:

a developing unit including a toner comprising a toner particle including a toner base particle containing a binder resin, with a projection containing an organosilicon polymer formed on a surface of the toner base particle;

the toner particle having a surface containing a polyvalent acid metal salt particle, the polyvalent acid metal salt particle containing at least one metal element selected from metal elements included in Groups 3 to 13; and an electrophotographic photosensitive member having a surface layer comprising at least one of an aluminum oxide particle, a silicon dioxide particle and a tin oxide particle.

2. The process cartridge according to claim 1, wherein a content of the aluminum oxide particle in the surface layer is 5.0 to 100 parts by mass with respect to 100 parts by mass of a resin component.

3. The process cartridge according to claim 1, wherein a content of the silicon dioxide particle in the surface layer is 0.5 to 30 parts by mass with respect to 100 parts by mass of a resin component.

4. The process cartridge according to claim 1, wherein a content of the tin oxide particle in the surface layer is 30 to 150 parts by mass with respect to 100 parts by mass of a resin component.

5. The process cartridge according to claim 1, wherein the surface of the toner particle comprises an organosilicon polymer.

6. The process cartridge according to claim 1, wherein the projection has a height of 30 to 300 nm.

7. An electrophotographic apparatus comprising a process cartridge, the process cartridge being detachably attachable to a main body of the electrophotographic apparatus and comprising:

a developing unit including a toner comprising a toner particle including a toner base particle containing a binder resin, with a projection containing an organosilicon polymer formed on a surface of the toner base particle;

the toner particle having a surface containing a polyvalent acid metal salt particle, the polyvalent acid metal salt particle containing at least one metal element selected from metal elements included in Groups 3 to 13; and an electrophotographic photosensitive member, having a surface layer comprising at least one of an aluminum oxide particle, a silicon dioxide particle and a tin oxide particle.

* * * * *